US008479445B2

(12) United States Patent
Ichinose

(10) Patent No.: US 8,479,445 B2
(45) Date of Patent: Jul. 9, 2013

(54) DOOR OPENING/CLOSING DEVICE

(75) Inventor: Mikio Ichinose, Yamanashi (JP)

(73) Assignee: Mitsui Kinzoku Act Corporation, Yokohama-shi (JP)

( * ) Notice: Subject to any disclaimer, the term of this patent is extended or adjusted under 35 U.S.C. 154(b) by 985 days.

(21) Appl. No.: 11/313,682

(22) Filed: Dec. 22, 2005

(65) Prior Publication Data

US 2006/0137248 A1 Jun. 29, 2006

(30) Foreign Application Priority Data

Dec. 28, 2004 (JP) ..... 2004-379884

(51) Int. Cl.
*E05F 11/28* (2006.01)

(52) U.S. Cl.
USPC ..... 49/341; 49/340; 49/342

(58) Field of Classification Search
USPC ..... 49/138, 339, 340, 341, 342; 74/437, 74/414, 393; 296/56, 146.8, 50, 57.1
See application file for complete search history.

(56) References Cited

U.S. PATENT DOCUMENTS

| | | | | | |
|---|---|---|---|---|---|
| 463,980 | A * | 11/1891 | Allen | 74/44 |
| 1,209,837 | A * | 12/1916 | Harris | 74/44 |
| 3,426,608 | A * | 2/1969 | Loughran et al. | 74/393 |
| 4,998,379 | A * | 3/1991 | Yamada et al. | 49/138 |
| 5,085,004 | A * | 2/1992 | Beauprez | 49/138 |
| 5,323,570 | A * | 6/1994 | Kuhlman et al. | 49/360 |
| 6,473,936 | B2 | 11/2002 | Orita | |
| 6,964,449 | B2 | 11/2005 | Takeda et al. | |
| 7,083,217 | B2 * | 8/2006 | Fukumoto et al. | 296/76 |
| 2002/0040551 | A1 * | 4/2002 | Zhou | 49/339 |
| 2004/0020319 | A1 * | 2/2004 | Inaba et al. | 74/414 |

FOREIGN PATENT DOCUMENTS

| | | | |
|---|---|---|---|
| JP | 60-117979 | U | 8/1985 |
| JP | 2554786 | B2 | 8/1996 |
| JP | 2715747 | B2 | 11/1997 |
| JP | 11-200708 | A | 7/1999 |
| JP | 2000-160935 | A | 6/2000 |
| JP | 2001-49953 | A | 2/2001 |
| JP | 2001-227237 | A | 8/2001 |
| JP | 2002-70420 | A | 3/2002 |
| JP | 2002-180741 | A | 6/2002 |
| JP | 2002-327575 | A | 11/2002 |
| JP | 2003-49585 | A | 2/2003 |
| JP | 2003-129749 | A | 5/2003 |
| JP | 3535036 | B2 | 3/2004 |
| JP | 2004-175235 | A | 6/2004 |

* cited by examiner

*Primary Examiner* — Gregory J. Strimbu
(74) *Attorney, Agent, or Firm* — Foley & Lardner LLP

(57) ABSTRACT

A device for controlling a door operated by a motor includes an opening/closing mechanism that opens and closes the door, and a gear mechanism that includes a plurality of tooth units each of which has different mesh and that conveys a torque of the motor to the opening/closing mechanism. The tooth units include a low-torque tooth unit that convey a relatively low torque, and a high-torque-tooth unit that conveys a relatively high torque. The torque conveyed to the opening/closing mechanism is changed by selecting a tooth unit based on a position of the door at the time of starting an opening or closing operation of the door.

3 Claims, 11 Drawing Sheets

DOOR OPENING/CLOSING DEVICE

BACKGROUND OF THE INVENTION

1. Field of the Invention

The present invention relates to a door opening/closing device for controlling opening and closing of a door.

2. Description of the Related Art

Generally, a door opening/closing device for controlling opening and closing of a door of a vehicle is provided with a door driving mechanism that includes a door opening/closing motor that drives the door to be open or closed. The door opening/closing device also includes a latch for holding the door to be closed. The latch includes a closer mechanism having a closer motor that drives the latch so that the latch in a half-latch state is brought to a full-latch state, and a release mechanism including a solenoid that drives the latch so that the latch in the full-latch state is released. In other words, in the above door opening/closing device, the door-closing operation is succeeded from the door driving mechanism to the closer mechanism when the door has brought to the half-latch state. Moreover, a door-opening operation is succeeded from the release mechanism to the door driving mechanism when the door has brought to a position at which the latch is released.

In the door-closing operation, a reaction force of a weatherstrip occurs. Due to the reaction force, transition from the door driving mechanism to the closer mechanism may not be conducted properly. In a conventional technology, for example, such a region that the door driving mechanism and the closer mechanism are simultaneously driven after the latch has brought to the half-latch state. Accordingly, the door is securely moved to a position to be the half-latch state by the door driving mechanism against the reaction force so that the closer mechanism can succeed the door-closing operation to bring the latch to the full-latch state (for example, Japanese Patent No. 2715747).

Another conventional door opening/closing device that includes reels and cables for controlling opening and closing of the door. The door opening/closing device rotates the reels connected with respective ends of the cables fixed to the door in forward and reverse directions with a motor to cause the reels to wind the cables therearound. In this apparatus, each of the reels includes a large diameter portion that winds the cable so as to provide a relatively high speed and a low power operation of the door, and a small diameter portion that winds the cable so as to provide a relatively low speed and a high power operation. Thus, the door is first moved at a high speed in a door-closing direction, and then, with a high power so that the door is closed against the reaction force (for example, Japanese Patent No. 2554786).

However, in the conventional door opening/closing device disclosed in Japanese Patent No. 2715747, if a load occurs at the transition between the door driving mechanism and the closer mechanism while the door driving mechanism and the closer mechanism are simultaneously driven, a catching detector (arranged separately) can erroneously determine that something is caught in the door. In this case, the door is controlled to be reversely moved to the door opening direction. Therefore, a specific control must be conducted to perform the transition from the door driving mechanism to the closer mechanism.

In the conventional door opening and closing device disclosed in Japanese Patent No. 2554786, if the cable is stretched or shrunk, or if the cable slides on the reel, power can be provided at positions deviated from desired positions.

SUMMARY OF THE INVENTION

It is an object of the present invention to at least solve the problems in the conventional technology.

A device according to one aspect of the present invention is for controlling a door operated by a motor and includes an opening/closing mechanism configured to open and close the door; and a gear mechanism including a plurality of tooth units each of which has different mesh, and configured to convey a torque of the motor to the opening/closing mechanism. The torque conveyed to the opening/closing mechanism is changed by selecting a tooth unit based on a position of the door at the time of starting an opening or closing operation of the door.

A device according to another aspect of the present invention is for controlling a door operated by a motor and includes an opening/closing mechanism configured to open and close the door; a gear mechanism including a plurality of tooth units each of which has different mesh, and configured to convey a torque of the motor to the opening/closing mechanism; and a controller configured to control the motor in such a manner that a rotation speed of the motor gradually changes while the tooth units are being switched. The torque conveyed is changed by selecting a tooth unit based on a position of the door at the time of starting an opening or closing operation of the door.

The other objects, features, and advantages of the present invention are specifically set forth in or will become apparent from the following detailed description of the invention when read in conjunction with the accompanying drawings.

DETAILED DESCRIPTION OF THE PREFERRED EMBODIMENTS

Exemplary embodiments of the present invention will be explained below in detail with reference to the accompanying drawings. Note that the invention is not limited by the embodiments.

Figure 1:
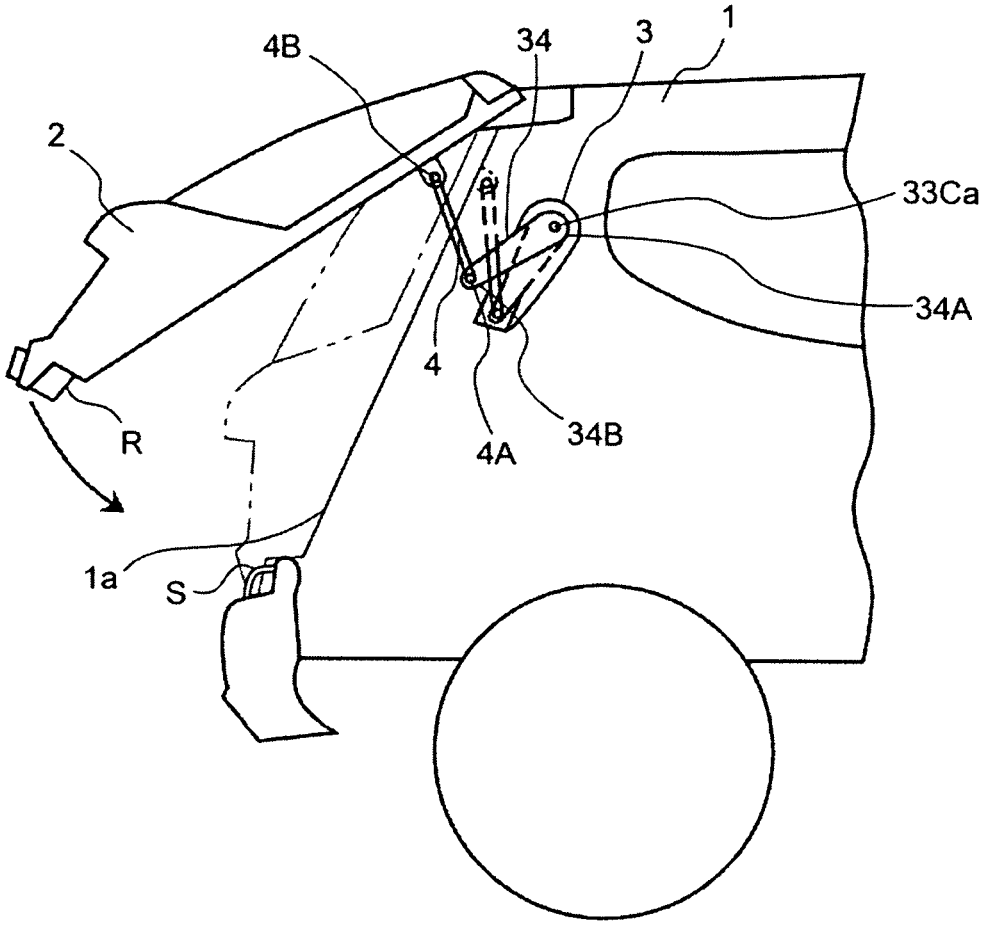
FIG. 1 is a schematic of a vehicle to which a door opening/closing device according to an embodiment of the present invention is applied.
Figure 2:
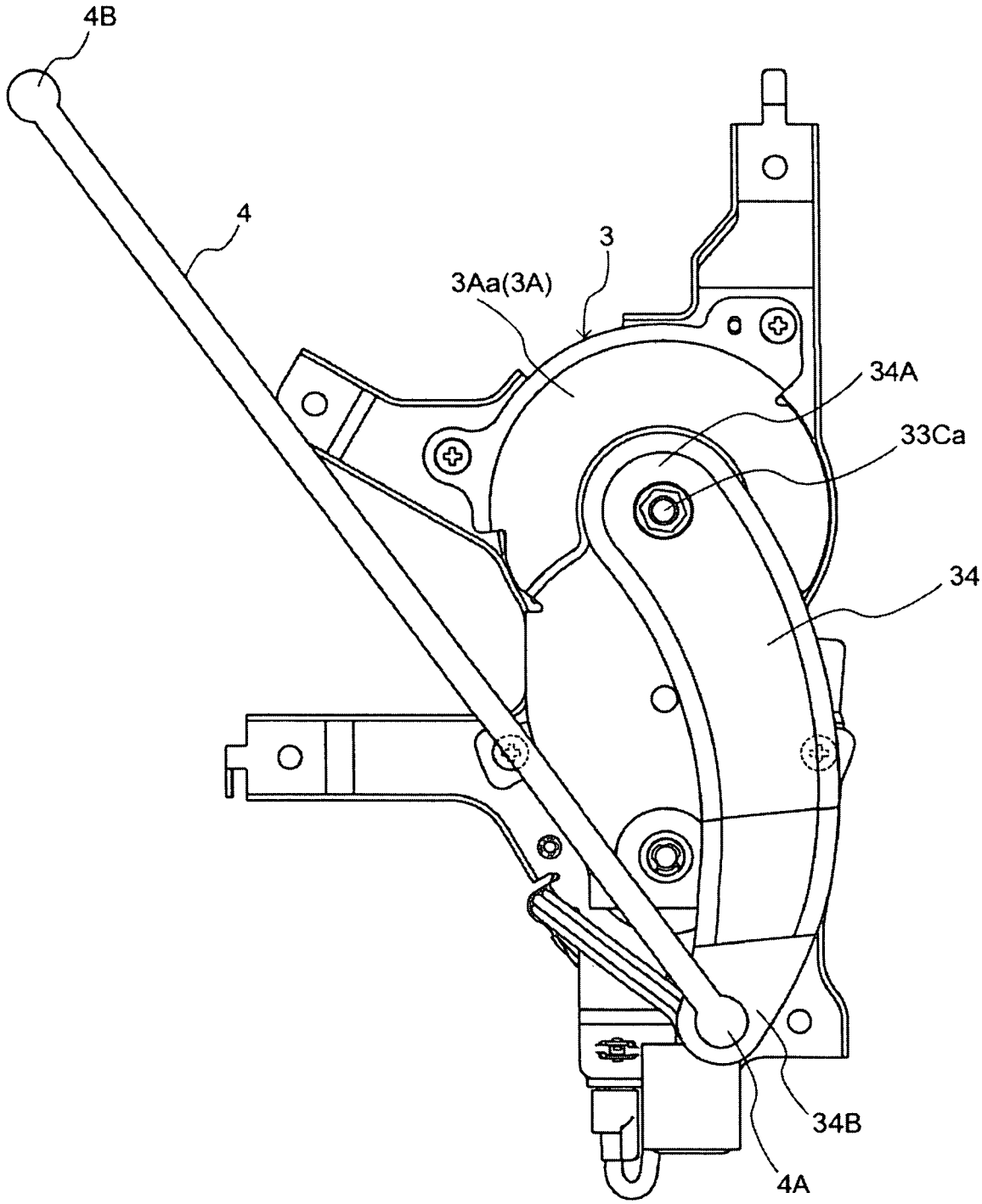
FIG. 2 is a front view of the door opening/closing device.
Figure 3:
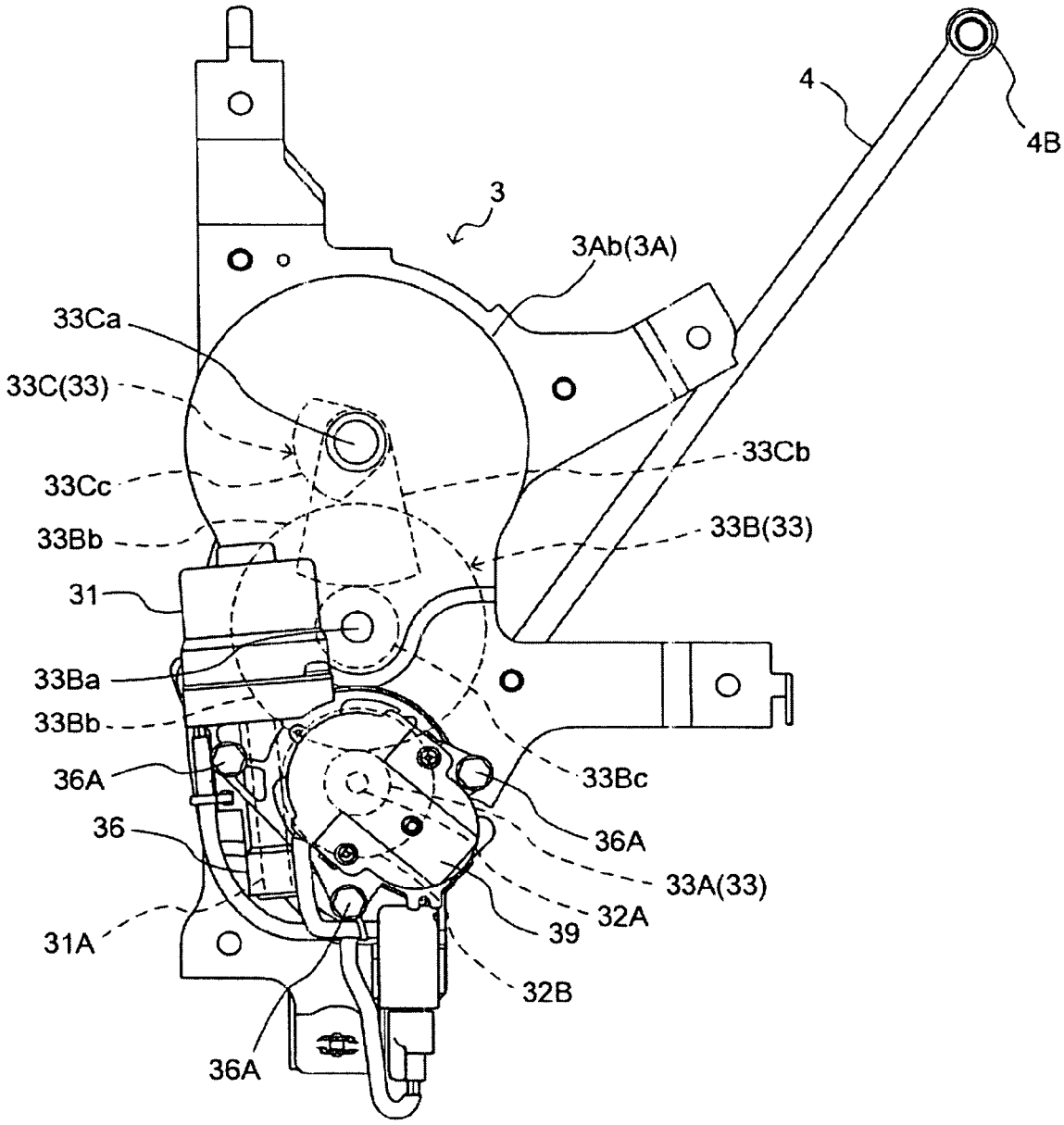
FIG. 3 is a rear view of the door opening/closing device.
Figure 4:
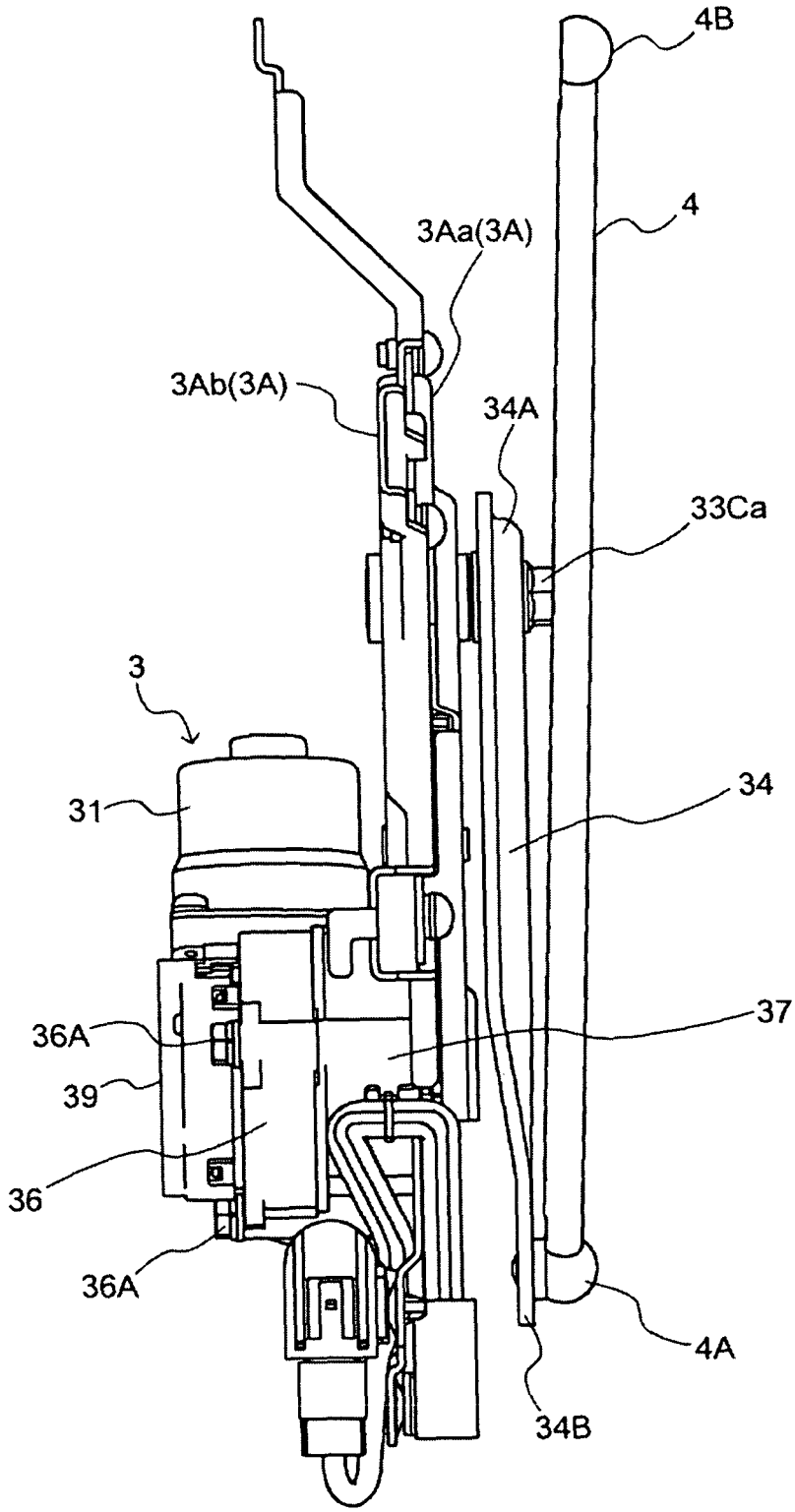
FIG. 4 is a side view of the door opening/closing device.
Figure 5:
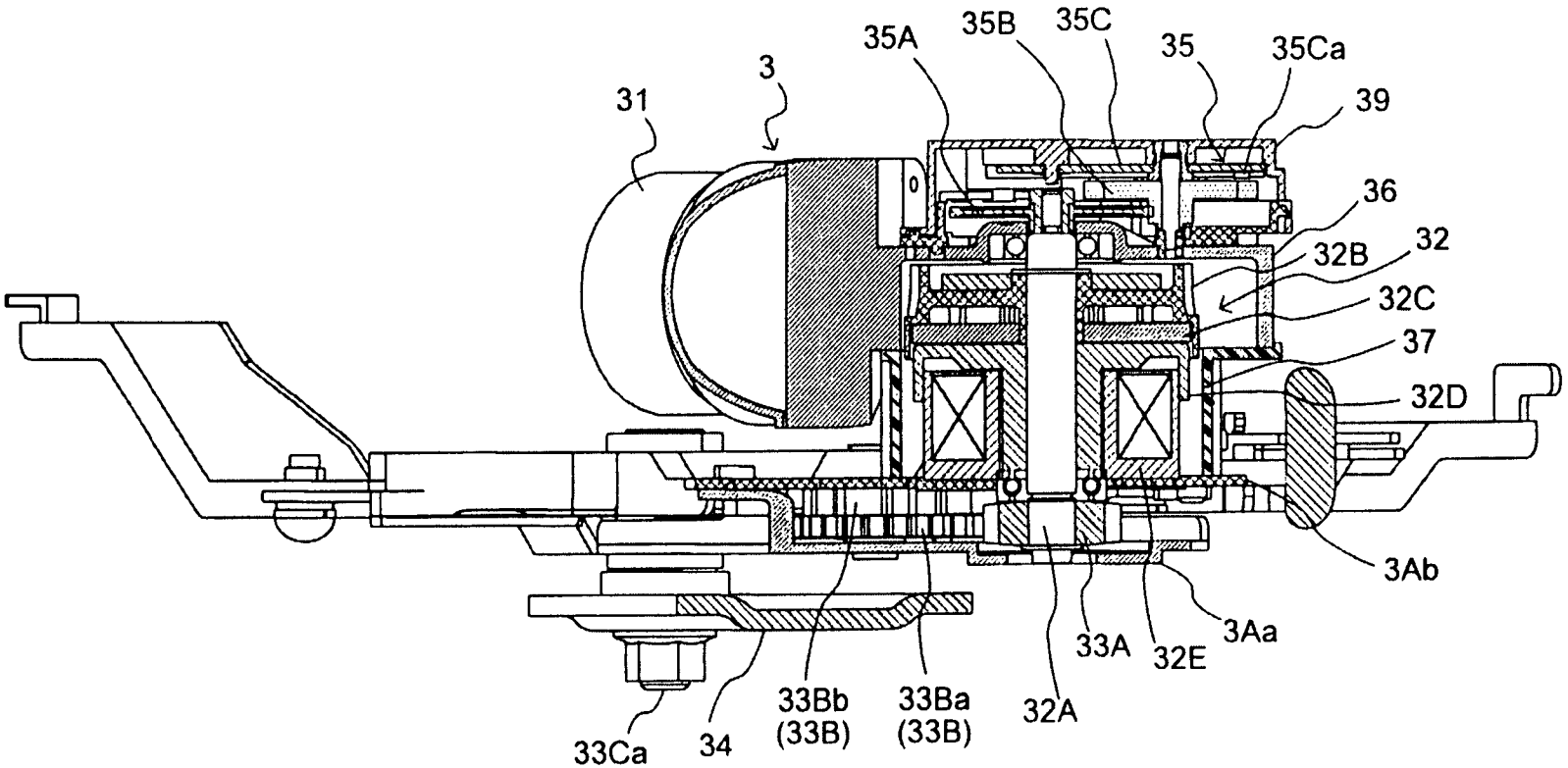
FIG. 5 is a cross-section of the door opening/closing device.
Figure 6:
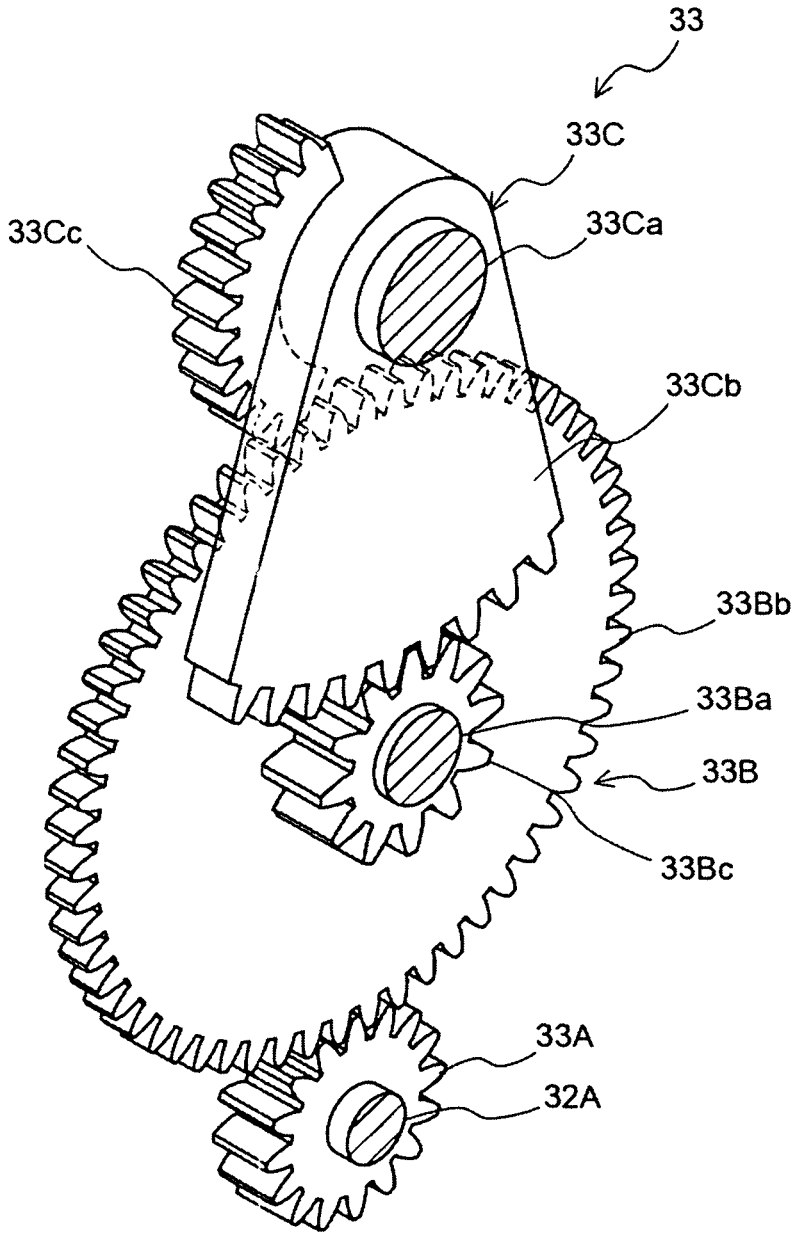
FIG. 6 is a perspective view of a driving gear group.

FIG. 1 is a schematic of a vehicle to which a door opening/closing device according to an embodiment of the present invention is applied, FIG. 2 is a front view of the door opening/closing device, FIG. 3 is a rear view of the door opening/closing device, FIG. 4 is a side view of the door opening/closing device, FIG. 5 is a cross-section of the door opening/closing device, and FIG. 6 is a perspective view of a driving gear group.

As shown in FIG. 1, a door opening/closing device according to the embodiment is provided between body 1 of a vehicle and a door (for example, a spring-up type back door) 2 for closing an opening 1*a* that is formed in the vehicle body 1. The door opening/closing device moves the door 2 to be open and closed. The door opening/closing device includes a driving unit 3, and a transmission rod 4 arranged between the driving unit 3 and the door 2. The transmission rod 4 constitutes a door opening and closing mechanism. The door opening/closing device transmits power of the driving unit 3 to the door 2 via the transmission rod 4, thereby moving the door 2. The door 2 is moved in a region between a full open position at which the door is fully open and a full closed position at which the door is completely closed. A latch R that engages with a striker S arranged at an edge of the opening 1*a* is arranged on at an end of the door 2 to hold the door 2 at the full closed position. The latch R can be a known member, and it takes a half-latch state, in which the latch R temporarily holds the door 2 positioned just before the full closed position, and a full-latch state, in which the latch R holds the door 2 at the full closed position. The latch R includes a release mechanism (not shown) including a solenoid for releasing the door 2 from a full-latch state. The release mechanism can be also a conventional one.

As shown in FIGS. 2 to 5, the driving unit 3 is arranged in a casing 3A constituting a base member of the door opening/closing device, and has a driving motor 31, a clutch 32, a driving gear group 33, an arm 34 constituting the door opening and closing mechanism, and a rotation sensor 35. The casing 3A is formed by combining a front cover 3Aa and a back cover 3Ab that are obtained by bending metal plates.

As shown in FIGS. 3 to 5, the driving motor 31 is attached to an outer face of the casing 3A, specifically, the back cover 3Ab. The driving motor 31 is disposed such that an output shaft (not shown) thereof extends downward. The driving motor 31 has a motor base 36 made from metal (for example, aluminum alloy) that houses a worm gear 31A including the output shaft. The driving motor 31 is fixed on the back cover 3Ab of the casing 3A by bolts 36A inserted into though-holes formed in the motor base 36.

As shown in FIG. 5, the clutch 32 is constituted as an electromagnetic clutch. The clutch 32 is housed in a clutch case 37 made from synthetic resin. The clutch case 37 is interposed between the motor base 36 and the back cover 3Ab, and it is fixed to the back cover 3Ab by the bolts 36A.

The clutch 32 includes a clutch shaft 32A, a worm wheel 32B, an armature 32C, a rotor 32D, and a coil unit 32E. One end of the clutch shaft 32A is rotatably supported to the motor base 36 in a state that the clutch shaft 32A is orthogonal to the output shaft of the driving motor 31, while the other end thereof is rotatably supported to the back cover 3Ab of the casing 3A. The worm wheel 32B is rotatably fit on the clutch shaft 32A to mesh with a worm gear 31A of the driving motor 31. The armature 32C is formed in a disc shape from magnetic substance and it is rotatably fit on the clutch shaft 32A. The armature 32C is provided to engage with the worm wheel 32B so as to move in an axial direction of the clutch shaft 32A and rotate together with the worm wheel 32B. The rotor 32D is fixed on the clutch shaft 32A so as to be opposed to the armature 32C. The coil unit 32E is arranged around the clutch shaft 32A. The rotor 32D is arranged between the coil unit 32E and the armature 32C. One end of the clutch shaft 32A extends through the motor base 36, while the other end thereof extends inside the casing 3A.

In the clutch 32, when the coil unit 32E is energized, the armature 32C is attracted toward the coil unit 32E to frictionally engage with the rotor 32D. Thereby, a driving force of the driving motor 31 via the worm gear 31A and the worm wheel 32B is transmitted to the clutch shaft 32A via the rotor 32D so that the clutch shaft 32A is rotated. On the other hand, when the coil unit 32E is not energized, the armature 32C and the rotor 32D separate from each other. Thereby, mutual transmission of power between the driving motor 31 and the clutch shaft 32A is released.

As shown in FIG. 5, the rotation sensor 35 is housed in a sensor case 39 fixed on a rear face of the motor base 36. The rotation sensor 35 includes a sensor gear 35A, a magnet disc 35B, and a sensor unit 35C. The sensor gear 35A is fixed at one end of the clutch shaft 32A extending through the motor base 36. The magnet disc 35B is obtained by forming a permanent magnet in a disc shape, and it is rotatably supported to the sensor case 39. The magnet disc 35B meshes with the sensor gear 35A. The sensor unit 35C is fixed on an inner face of the sensor case 39 and it has two hall integrated circuits (ICs) 35Ca for detecting rotation of the magnet disc 35B.

In the rotation sensor 35, when a driving force of the driving motor 31 is transmitted to the clutch shaft 32A via connection of the clutch 32, the sensor gear 35A is rotated according to rotation of the clutch shaft 32A. The magnet disc 35B is rotated according to rotation of the sensor gear 35A and the rotation is detected by the respective hall ICs 35Ca of the sensor unit 35C. The respective hall ICs 35Ca output pulse signals with different phases according to driving of the driving motor 31.

As shown in FIGS. 3 and 6, the driving gear group 33 includes an output gear 33A, an intermediate gear 33B, and a driving gear 33C.

The output gear 33A is fixed to the other end of the clutch shaft 32A inside the casing 3A. That is, the output gear 33A is rotated via the clutch 32 according to rotation of the driving motor 31.

The intermediate gear 33B is fixed to an intermediate gear shaft 33Ba supported inside the casing 3A so as to be parallel to the clutch shaft 32A. The intermediate gear 33B is constituted by concentrically stacking and unitizing a large diameter gear 33Bb and a small diameter gear 33Bc having a diameter smaller than that of the large diameter gear 33Bb. The large diameter gear 33Bb of the intermediate gear 33B meshes with the output gear 33A and a small diameter sector gear 33Cc of the driving gear 33C described later. The small diameter gear 33Bc of the intermediate gear 33B meshes with a large diameter sector gear 33Cb of the driving gear 33C.

The driving gear 33C is fixed to the driving shaft 33Ca supported in the casing 3A so as to be parallel to the clutch shaft 32A and the intermediate gear shaft 33Ba. The driving shaft 33Ca extends toward a front face of the casing 3A. The driving gear 33C is constituted by concentrically stacking and unitizing the large diameter sector gear 33Cb and the small diameter sector gear 33Cc having a diameter smaller than that of the large diameter sector gear 33Cb. The large diameter sector gear 33Cb of the driving gear 33C is formed in a fan shape having teeth on an arc face and meshes with the small diameter gear 33Bc of the intermediate gear 33B. The small diameter sector gear 33Cc of the driving gear 33C is formed in a fan shape having teeth on an arc face and meshes with the large diameter gear 33Bb of the intermediate gear 33B.

The driving gear 33C includes the large diameter sector gear 33Cb and the small diameter sector gear 33Cc so as to satisfy the following relationship. When the large diameter sector gear 33Cb meshes with the small diameter gear 33Bc of the intermediate gear 33B, the small diameter sector gear 33Cc is released from the meshing state with the large diameter gear 33Bb of the intermediate gear 33B. On the other hand, when the small diameter sector gear 33Cc mainly meshes with the large diameter gear 33Bb of the intermediate gear 33B, the large diameter sector gear 33Cb is released from the small diameter gear 33Bc of the intermediate gear 33B. Thus, the driving gear 33C is constituted such that the large diameter sector gear 33Cb and the small diameter sector gear 33Cc correspond to the intermediate gear 33B independently of each other.

In the driving gear group 33, when a driving force of the driving motor 31 is transmitted to the clutch shaft 32A via the clutch 32, the output gear 33A is rotated according to rotation of the clutch shaft 32A. At that time, the intermediate gear 33B with which the large diameter gear 33Bb meshes rotates around the intermediate gear shaft 33Ba according to the rotation of the output gear 33A. The driving shaft 33Ca is rotated via the driving gear 33C with the large diameter sector gear 33Cb or the small diameter sector gear 33Cc meshes according to the rotation of the intermediate gear 33B. When the small diameter sector gear 33Cc meshes with the large diameter gear 33Bb, rotation of the intermediate gear 33B is transmitted from the large diameter gear 33Bb to the small diameter sector gear 33Cc, so that rotation speed of the driving shaft 33Ca is made relatively high. On the other hand, when the large diameter sector gear 33Cb meshes with the small diameter gear 33Bc, rotation of the intermediate gear 33B is transmitted from the small diameter gear 33Bc to the large diameter sector gear 33Cb, so that rotation speed of the driving shaft 33Ca is made relatively low.

The arm 34 together with the transmission rod 4 constitutes the door opening and closing mechanism, and a proximal end 34A thereof is fixed to the driving shaft 33Ca extending toward the front face of the casing 3A, as shown in FIGS. 2, 4, and 5. That is, the arm 34 is rotated according to rotation of the driving shaft 33Ca. The transmission rod 4 is attached to a rotating end 34B of the arm 34. As shown in FIGS. 1, 2, and 4, the transmission rod 4 is formed in an elongated rod shape, and one end 4A thereof is attached to a rotating end 34B of the arm 34, while another end 4B thereof is attached to the door 2. The transmission rod 4 moves the door 2 in an opening direction or a closing direction thereof according to rotation of the arm 34 of the driving unit 3. Thus, the door opening/closing device transmits rotation of the driving motor 31 to the door opening and closing mechanism via the driving gear group 33 to move the door 2 to the vehicle body 1 for opening and closing.

That is, the intermediate gear 33B and the driving gear 33C in the driving gear group 33 constitute a variable-speed gear mechanism having different meshing teeth for changing a rotational speed to be transmitted to the door opening and closing mechanism in a state that rotation speed of the driving motor 31 is kept constant during opening or closing operation of the door 2. The variable-speed gear mechanism has high speed meshing teeth constituted to transmit relatively high speed rotation to the driving shaft 33Ca by meshing between the large diameter gear 33Bb of the intermediate gear 33B and the small diameter sector gear 33Cc of the driving gear 33. Furthermore, the variable-speed gear mechanism also has low speed meshing teeth constituted to transmit relatively low speed rotation to the driving shaft 33Ca by meshing between the small diameter gear 33Bc of the intermediate gear 33B and the large diameter sector gear 33Cb of the driving gear 33C. The high speed meshing teeth and the low speed meshing teeth may be arranged to partially overlap with each other in a transition section between the high speed meshing teeth and the low speed meshing teeth, and may be arranged not to overlap with each other at all. When a transition between the high speed meshing teeth and the low speed meshing teeth cannot be performed smoothly due to meshing between both the high speed meshing teeth and the low speed meshing teeth caused by the partial overlapping therebetween, for example, such a constitution can be employed that both or one of the large diameter sector gear 33Cb and the small diameter sector gear 33Cc is provided independently of the driving shaft 33Ca, and an independent gear is provided for the driving shaft such that a relative position between the large diameter sector gear 33Cb and the small diameter sector gear 33Cc can be restored.

Figure 7:
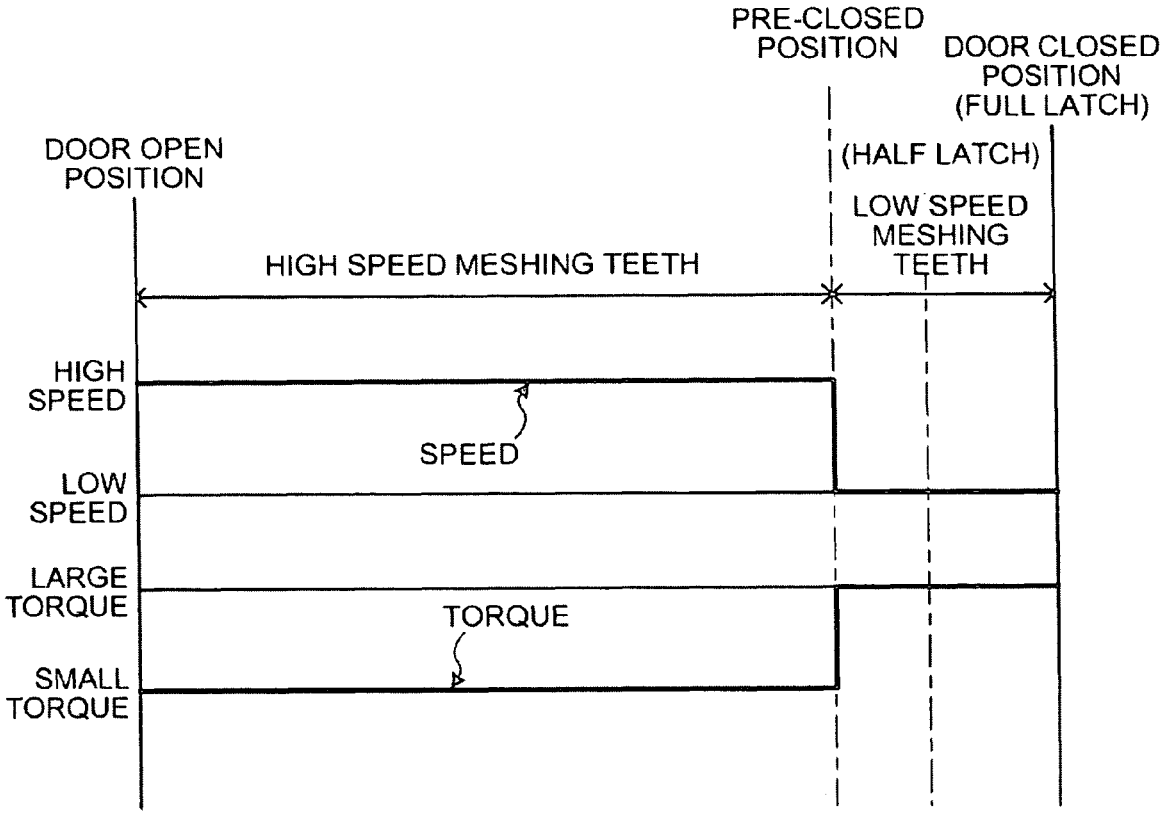
FIG. 7 depicts a transmission speed and a transmission torque obtained by a variable-speed-gear mechanism.
Figure 8:
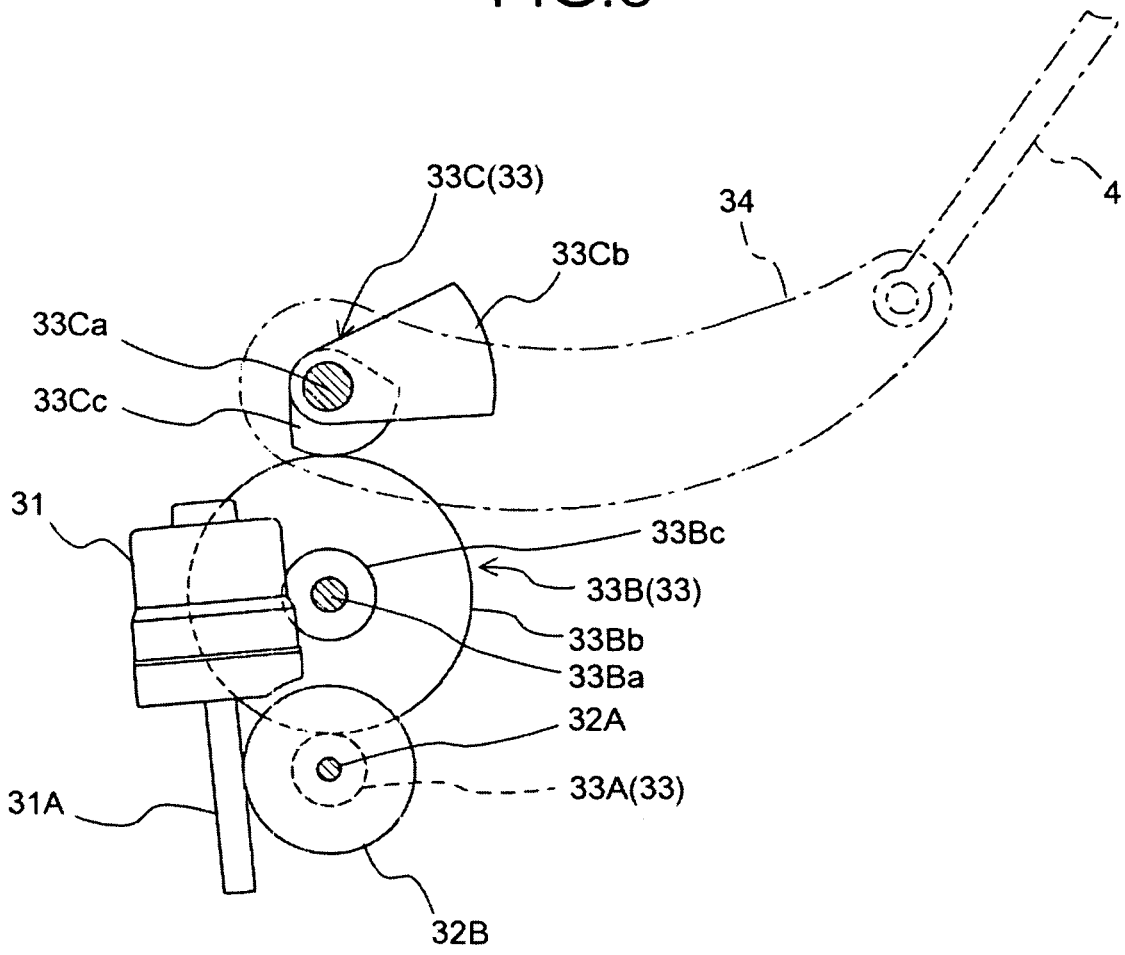
FIG. 8 is a schematic of the door opening/closing device in a fully-open state.
Figure 9:
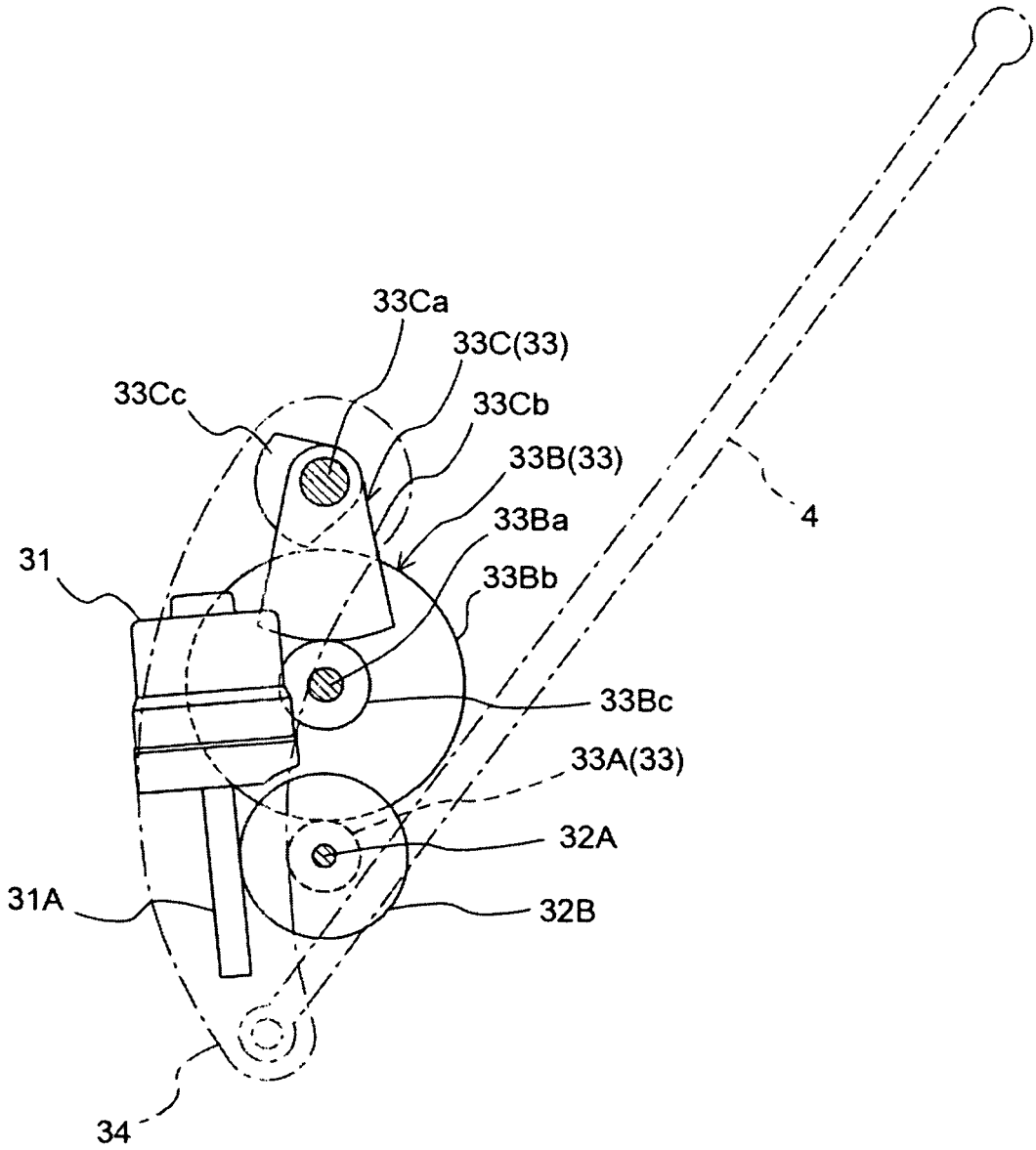
FIG. 9 is a schematic of the door opening/closing device in a fully-closed state.

In the variable-speed gear mechanism, as shown in FIG. 7, a meshing state between the high speed meshing teeth (the large diameter gear 33Bb and the small diameter sector gear 33Cc) means that the door 2 is positioned in a door opening and closing section between a door open position (see FIG. 8) that is the full open position and a pre-closed position that is a position just before the full closed position at which the door 2 becomes almost completely closed. On the other hand, in the variable-speed gear mechanism, as shown in FIG. 7, a meshing state between the low speed meshing teeth (the small diameter gear 33Bc and the large diameter sector gear 33Cb) means that the door 2 is positioned in a region between the pre-closed position and the full closed position (see FIG. 9) at which the latch R becomes in the full-latch state. The pre-closed position means a position just before the latch R is transferred to the half-latch state while the door 2 is moved from the full open position to the full closed position. The pre-closed position corresponds to such a position of the door 2 that leaves the opening 1*a* open for, for example, about 30 centimeters, which is likely to catch a part of human body.

That is, when the door 2 is moved from the full open position to the full closed position, a rotation speed to be transmitted toward the door opening and closing mechanism is made relatively high in the section from the full open position to the pre-closed position by the high speed meshing teeth in the variable-speed gear mechanism, while the rotation speed of the driving motor 31 is kept constant, so that the door 2 is rapidly moved for closing in that section. Since rotation speed to be transmitted to the door opening/closing device is made relatively low in the section from the pre-closed position to the full closed position by the low speed meshing teeth in the variable-speed gear mechanism, the door 2 is moved slowly in that section. Therefore, it is possible to reduce such a concern that a part of body is caught by the door 2 even when the door 2 moves to the pre-closed position. Furthermore, since the torque for closing the door 2 becomes large in the section from the pre-closed position to the full closed position due to a low rotation speed of the driving motor, a closing force for transferring the latch R from the half-latch state to the full-latch state against the reaction force of the weatherstrip can be obtained. Accordingly, the closer mechanism for transferring the latch R from the half-latch state to the full-latch state is unnecessary, thereby reducing a weight and manufacturing cost of the door 2.

When the door 2 is moved from the full closed position to the full open position after releasing the latch R, since rotation speed to be transmitted to the door opening and closing mechanism is made relatively low in the full closed position to the pre-closed position by the low speed meshing teeth in the variable-speed gear mechanism, while rotation of the driving motor 31 is kept constant, the door 2 is opened slowly in that section. Since rotation speed to be transmitted to the door opening and closing mechanism is made relatively high in the section from the pre-closed position to the full open position by the high speed meshing teeth, the door 2 is opened rapidly in that section. Accordingly, it is possible to ease uncomfortable feeling due to rapid movement of the door 2 from the full closed position.

In the door opening/closing device, therefore, since the rotation speed to be transmitted to the door opening/closing device is made variable by different meshing states in the variable-speed gear mechanism according to a position of the door 2, a moving speed and a torque of the door 2 can be made variable without performing a special control on the driving unit 3 unlike the conventional technology.

In addition to the above embodiment, for example, such a constitution can be adopted that low speed meshing teeth are additionally arranged in the region between the full open position and a pre-open position that is a position just before the full open position at which the door 2 becomes almost fully open. With such a constitution, the door can be opened or closed slowly at the full open position, and when a latch is arranged at the full open position, a torque for engagement with the latch can be obtained. In the door opening/closing device, therefore, a speed in which the door 2 is moved can be changed depending on a position of the door 2.

In the above embodiment, the constitution including the large diameter gear 33Bb and the small diameter sector gear 33Cc constituting the high speed meshing teeth, and the small diameter gear 33Bc and the large diameter sector gear 33Cb constituting the low speed meshing teeth has been explained as the variable-speed gear mechanism. However, the variable-speed gear mechanism is not limited to such a constitution. Though not shown, another embodiment including a rack and pinion mechanism can be constituted by providing racks with different tooth heights in parallel and combining the racks with pinions having different diameters meshing with the respective racks. In addition, various gear structure where rotation speed can be changed or made variable through a series of meshing states can be adopted as the variable-speed gear mechanism.

Figure 10:
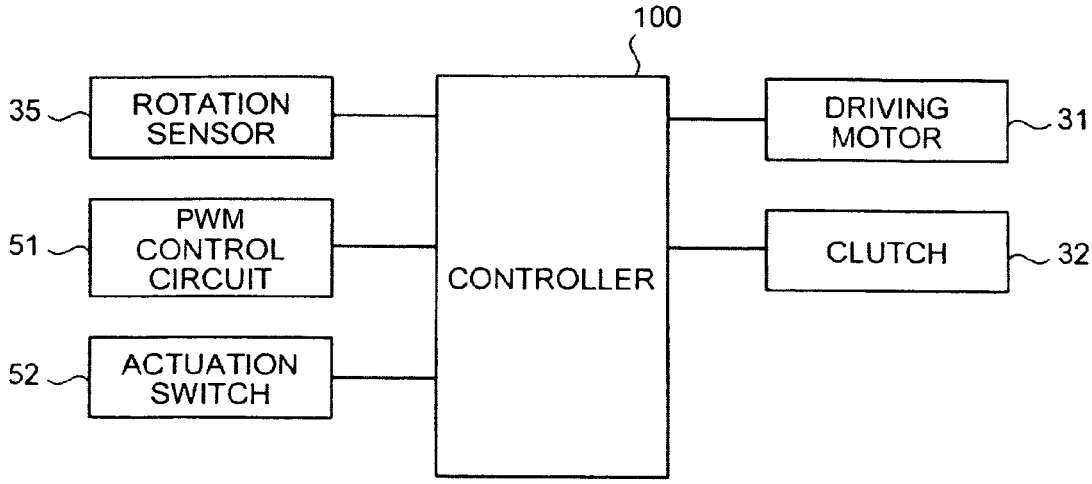
FIG. 10 is a block diagram of a control system for the door opening/closing device.

FIG. 10 is a block diagram of a control system for the door opening/closing device. A controller 100 shown in FIG. 10 integrally controls the door opening/closing device according to data or a program(s) stored in advance. The controller 100 is connected with the rotation sensor 35, a pulse width modulation (PWM) control circuit 51, an actuation switch 52, the driving motor 31, and the clutch 32.

The rotation sensor 35 outputs pulses having different phases according to driving of the driving motor 31, as described above. The controller 100 receives different pulse signals according to the pulses with the different phases, thereby detecting a rotation speed and a rotation direction of the driving motor 31, that is, an opening or closing position and an opening direction or closing direction of the door 2.

The PWM control circuit 51 is for controlling a voltage to be supplied to the driving motor 31, where the rotation speed of the driving motor 31, namely, moving speed of the door 2 can be changed by changing a time duration of voltage application.

The actuation switch 52 is for an opening or closing actuation of the door 2. The actuation switch includes a main switch, a driver seat switch, a rear seat switch, an inner handle switch, an outer handle switch, and a keyless switch. The main switch is for making opening or closing control of the door opening/closing device effective, and the door opening/closing device can be controlled for opening and closing, only when the main switch is on. Accordingly, when the main switch is off, the door 2 must be opened or closed manually. Each of the other switches outputs an instruction signal for moving or stopping the door 2.

Figure 11:
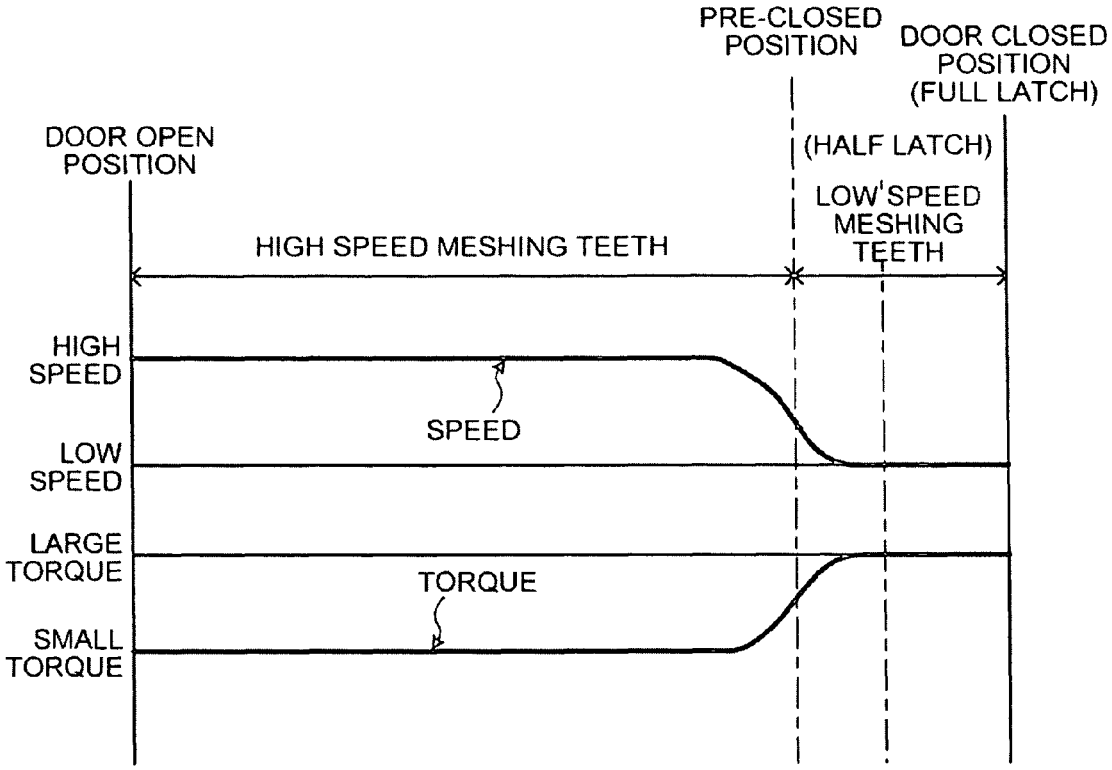
FIG. 11 is a schematic for illustrating a door speed control by an opening/closing control unit when the door is positioned near a door closing position.

The controller 100 adjusts rotation of the driving motor 31 such that rotation speed to be transmitted to the door opening/closing device gradually changes in the section where switching between meshing states of the meshing teeth in the variable-speed gear mechanism. Specifically, as shown in FIG. 11, when the high speed meshing teeth (the large diameter gear 33Bb and the small diameter sector gear 33Cc) are in a meshing state, and the low speed meshing teeth (the small diameter gear 33Bc and the large diameter sector gear 33Cb) are in a meshing state, the door 2 is moved, while rotation of the driving motor 31 is kept constant. As regards the pre-closed position where switching between meshing states of respective meshing teeth occurs, the controller 100 reduces rotation speed of the driving motor 31 to make moving speed of the door 2 slow at a position where the high speed meshing teeth are in the meshing state. Furthermore, the controller 100 increases rotation speed of the driving motor 31 to make moving speed of the door fast at a position where the low speed meshing teeth are in a meshing state. Accordingly, as shown in FIG. 11, the moving speed of the door 2 can be changed smoothly in the section (near door closed position that is the pre-closed position) where switching between the high speed meshing teeth and the low speed meshing teeth occurs. The controller 100 can control the driving motor 31 during door-closing or door-opening actuation such that the motor rotation speed (door moving speed) gradually changes from a low speed to a high speed at a starting time of actuation, and the motor rotation speed (door moving speed) gradually changes from a high speed to a low speed at a terminating time of actuation. Thus, the whole actuation can be performed smoothly.

While in the embodiment described above, the example where the door 2 is the back door has been explained, the present invention is not limited to the example. The invention is applicable to a trunk lid, a side hinge door or the like. Furthermore, the invention can be similarly adopted for a sliding door of a gear type.

According to the embodiments described above, a moving speed and a torque of a door can be changed without a special control of a driving motor.

Moreover, according to the embodiments described above, the moving speed is smoothly changed.

Furthermore, according to the embodiments described above, it is possible to ease fear that a part of body of a user can be caught in the door.

Moreover, according to the embodiments described above, a force against a reaction force of the weatherstrip can be obtained. Accordingly, a closer mechanism for transferring a latch from the half-latch state to the full-latch state is unnecessary, thereby reducing a weight and manufacturing cost of the door.

Furthermore, according to the embodiments described above, a rotational speed is relatively high in the section from the full open position to the pre-closed position, thereby closing the door rapidly.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

This application claims priority from Japanese Patent Application 2004-379884, filed Dec. 28, 2004, which is incorporated herein by reference in its entirety.

What is claimed is:

1. A device for controlling a door operated by a motor, comprising:

an opening and closing mechanism configured to open and close the door in a first region between a full open position and a pre-closed position of the door and in a second region between the pre-closed position and a full closed position of the door, wherein the pre-closed position is a position just before a latch for the door is transferred to a half-latch state while the door is moved from the full open position to the full closed position; and a gear mechanism including an output gear that rotates according to rotation of the motor and a plurality of tooth units, the gear mechanism being configured to convey a torque of the motor to the opening and closing mechanism which is fixed to a driving shaft, wherein the plurality of tooth units includes an intermediate gear including a large diameter gear and a small diameter gear and being constituted by concentrically stacking and unitizing the large diameter gear and the small diameter gear, and a driving gear that is fixed to the driving shaft which rotates an arm of the opening and closing mechanism, the driving gear including a large diameter sector gear and a small diameter sector gear and being constituted by concentrically stacking and unitizing the large diameter sector gear and the small diameter sector gear, wherein the large diameter gear of the intermediate gear and the small diameter sector gear of the driving gear are meshed when the door is positioned between the full open position and the pre-closed position, and constitute a low-torque tooth unit that conveys a low torque, wherein the large diameter sector gear of the driving gear and the small diameter gear of the intermediate gear are meshed when the door is positioned between the pre-closed position and the full closed position, and constitute a high-torque tooth unit that conveys a high torque, wherein one of the low-tooth units to be meshed with each other is selected from the low-torque tooth unit and the high-torque tooth unit is meshed based on a position of the door when an opening or closing operation of the door is started such that a first rotation speed of the driving shaft transmitted to the opening and closing mechanism in the first region is higher than a second rotation speed of the driving shaft transmitted to the opening and closing mechanism in the second region to change the torque conveyed to the opening and closing mechanism, wherein when the large diameter sector gear meshes with the small diameter gear in the second region, the small diameter sector gear is released from the large diameter gear, wherein when the small diameter sector gear meshes with the large diameter gear in the first region, the large diameter sector gear is released from the small diameter gear, and wherein a rotation speed of the motor is adjusted such that the rotation speed of the motor gradually changes when switching between the low-torque tooth unit and the high-torque tooth unit.

2. A device for controlling a door operated by a motor, comprising:

an opening and closing mechanism configured to open and close the door in a first region between a full open position and a pre-closed position of the door and in a second region between the pre-closed position and a full closed position of the door, wherein the pre-closed position is a position just before a latch for the door is transferred to a half-latch state while the door is moved from the full open position to the full closed position; and a gear mechanism configured to convey a torque of the motor to the opening and closing mechanism which is fixed to a driving shaft, wherein the gear mechanism comprises:

an output gear that rotates according to rotation of the motor, an intermediate gear including a large diameter gear and a small diameter gear and being constituted by concentrically stacking and unitizing the large diameter gear and the small diameter gear, and a driving gear that is fixed to the driving shaft which rotates an arm of the opening and closing mechanism, the driving gear including a large diameter sector gear and a small diameter sector gear and being constituted by concentrically stacking and unitizing the large diameter sector gear and the small diameter sector gear, wherein the large diameter gear of the intermediate gear and the small diameter sector gear of the driving gear are meshed when the door is positioned between the full open position and the pre-closed position, and constitute a low-torque tooth unit that conveys a low torque, wherein the large diameter sector gear of the driving gear and the small diameter gear of the intermediate gear are meshed when the door is positioned between the pre-closed position and the full closed position, and constitute a high-torque tooth unit that conveys a high torque, wherein the low-torque tooth unit and the high-torque tooth unit each has a different mesh, wherein one of the low-torque tooth unit and the high-torque tooth unit is meshed based on a position of the door when an opening or closing operation of the door is started such that a first rotation speed of the driving shaft transmitted to the opening and closing mechanism in the first region is higher than a second rotation speed of the driving shaft transmitted to the opening and closing mechanism in the second region, wherein when the large diameter sector gear meshes with the small diameter gear in the second region, the small diameter sector gear is released from the large diameter gear, wherein when the small diameter sector gear meshes with the large diameter gear in the first region, the large diameter sector gear is released from the small diameter gear, and wherein a rotation speed of the motor is adjusted such that the rotation speed of the motor gradually changes when switching between the low-torque tooth unit and the high-torque tooth unit.

3. A device for controlling a door operated by a motor, comprising:

an opening and closing mechanism configured to open and close the door in a first region between a full open position and a pre-closed position of the door and in a second region between the pre-closed position and a full closed position of the door, wherein the pre-closed position is a position just before a latch for the door is transferred to a half-latch state while the door is moved from the full open position to the full closed position;

a gear mechanism configured to convey a torque of the motor to the opening and closing mechanism which is fixed to a driving shaft; and a controller, wherein the gear mechanism comprises:

an output gear that rotates according to rotation of the motor, an intermediate gear including a large diameter gear and a small diameter gear and being constituted by concentrically stacking and unitizing the large diameter gear and the small diameter gear, and a driving gear that is fixed to the driving shaft which rotates an arm of the opening and closing mechanism, wherein the driving gear includes a large diameter sector gear and a small diameter sector gear and is constituted by concentrically stacking and unitizing the large diameter sector gear and the small diameter sector gear, wherein the large diameter gear of the intermediate gear and the small diameter sector gear of the driving gear are meshed when the door is positioned between the full open position and the pre-closed position, and constitute a low-torque tooth unit that conveys a low torque, wherein the large diameter sector gear of the driving gear and the small diameter gear of the intermediate gear are meshed when the door is positioned between the pre-closed position and the full closed position, and constitute a high-torque tooth unit that conveys a high torque, wherein one of the low-torque tooth unit and the high-torque tooth unit is meshed based on a position of the door when an opening or closing operation of the door is started such that a first rotation speed of the driving shaft transmitted to the opening and closing mechanism in the first region is higher than a second rotation speed of the driving shaft transmitted to the opening and closing mechanism in the second region, wherein when the large diameter sector gear meshes with the small diameter gear in the second region, the small diameter sector gear is released from the large diameter gear, wherein when the small diameter sector gear meshes with the large diameter gear in the first region, the large diameter sector gear is released from the small diameter gear, wherein the controller is configured to control the motor, wherein the controller adjusts the rotation of the motor such that a rotation speed of the motor gradually changes when switching between the low-torque tooth unit and the high-torque tooth unit.

* * * * *